US005584454A

United States Patent [19]

Saunders et al.

[11] Patent Number: 5,584,454

[45] Date of Patent: Dec. 17, 1996

[54] EXTENSIBLE SUPPORT MEANS FOR USE ON LADDER

[76] Inventors: Alton M. Saunders; Esther S. Saunders, both of 418 Seville Ave., Altamonte Springs, Fla. 32712

[21] Appl. No.: 516,137

[22] Filed: Aug. 17, 1995

Related U.S. Application Data

[63] Continuation-in-part of Ser. No. 306,985, Sep. 16, 1994, abandoned.

[51] Int. Cl.[6] ..... E06C 7/14

[52] U.S. Cl. ..... 248/211; 248/298

[58] Field of Search ..... 248/210, 211, 248/238, 286.1, 285.1, 307, 297.21, 298.11, 296.1; 182/129

[56] References Cited

U.S. PATENT DOCUMENTS

| | | | |
|---|---|---|---|
| 625,271 | 5/1899 | Lang | 248/297.21 |
| 666,099 | 1/1901 | Kepler | 248/297.21 |
| 1,751,691 | 3/1930 | Flath | 248/285.1 |
| 1,800,386 | 4/1931 | Hoffman | 248/307 |
| 2,243,799 | 5/1941 | Glasier | 248/211 |
| 2,417,036 | 3/1947 | Zelenko | 248/307 |
| 2,541,434 | 2/1951 | Nelson | 248/210 |
| 2,651,489 | 9/1953 | Bell | 248/297.21 |
| 2,979,296 | 4/1961 | Groocock | 248/285.1 |
| 3,078,484 | 2/1963 | Briggs | 248/297.21 |
| 4,815,734 | 3/1989 | Verhulst | 248/297.21 |

*Primary Examiner*—Leslie A. Braun
*Assistant Examiner*—Gwendelyn A. Wrenn
*Attorney, Agent, or Firm*—Julian C. Renfro, Esq.

[57] ABSTRACT

A support device for utilization on a ladder comprising an elongate base member having a pair of long edges, between which a mounting device is provided such that the base member can be secured to an upper part of a ladder. An elongate receptacle extends for substantially the entire length of the base member, with the ends as well as the upper portion of the receptacle being open, and with a restraint device defined in a mid portion of the receptacle. A slidable member of elongate configuration is provided, having a dimension such as to be able to reside in the elongate receptacle. The slidable member has first and second ends as well as a longitudinal centerline, with a slot extending along the centerline for a substantial portion of the length of the slidable member, with the slot extending relatively close to the first end of the slidable member. A component support device is provided on the second end. The slidable member is insertable over the restraint device, with the restraint device extending into the slot. The slidable member is able to be slid out of either end of the elongate receptacle, with the engagement of the restraint device with the slot preventing the slidable member from coming entirely out of the receptacle. Advantageously, the slidable member is pivotally rotatable about the restraint device, so as to be usable by either a right-handed or a left-handed worker.

15 Claims, 3 Drawing Sheets

FIG 1
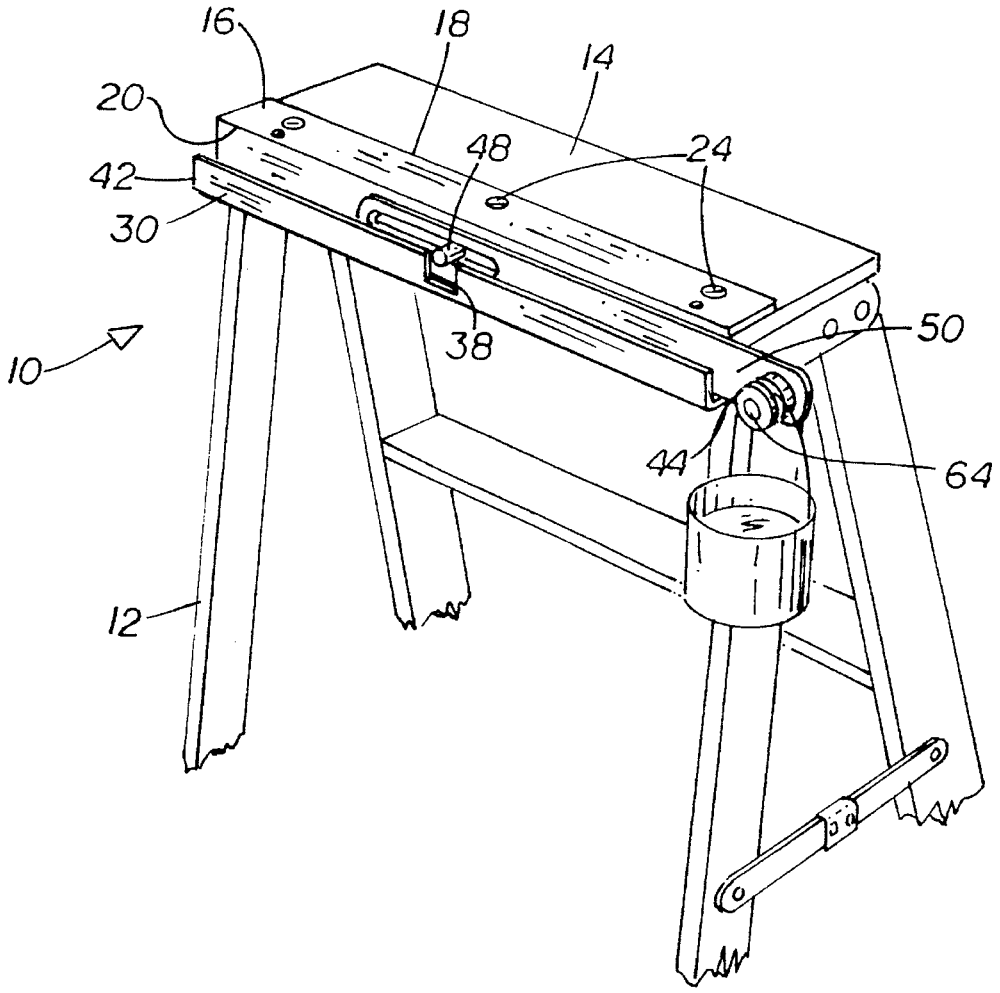
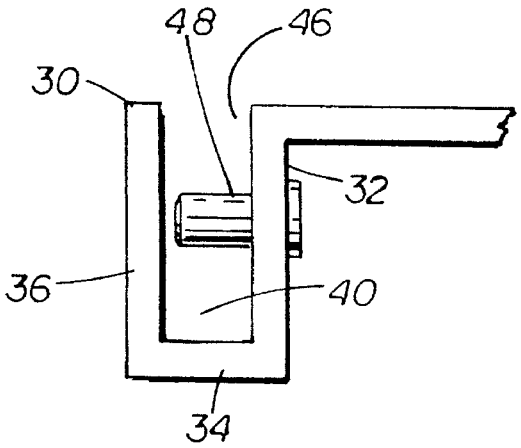
FIG 1a

FIG 3
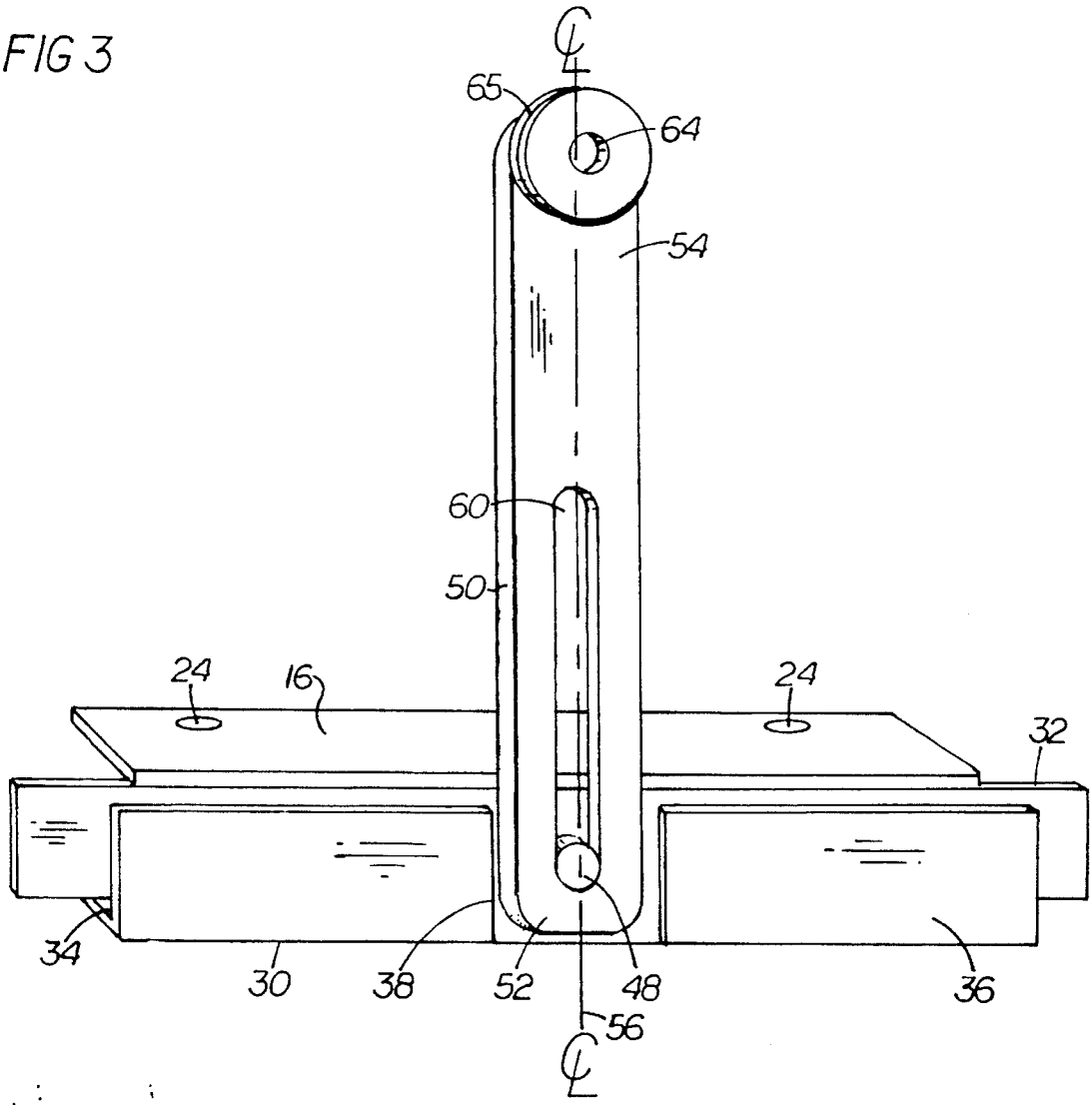
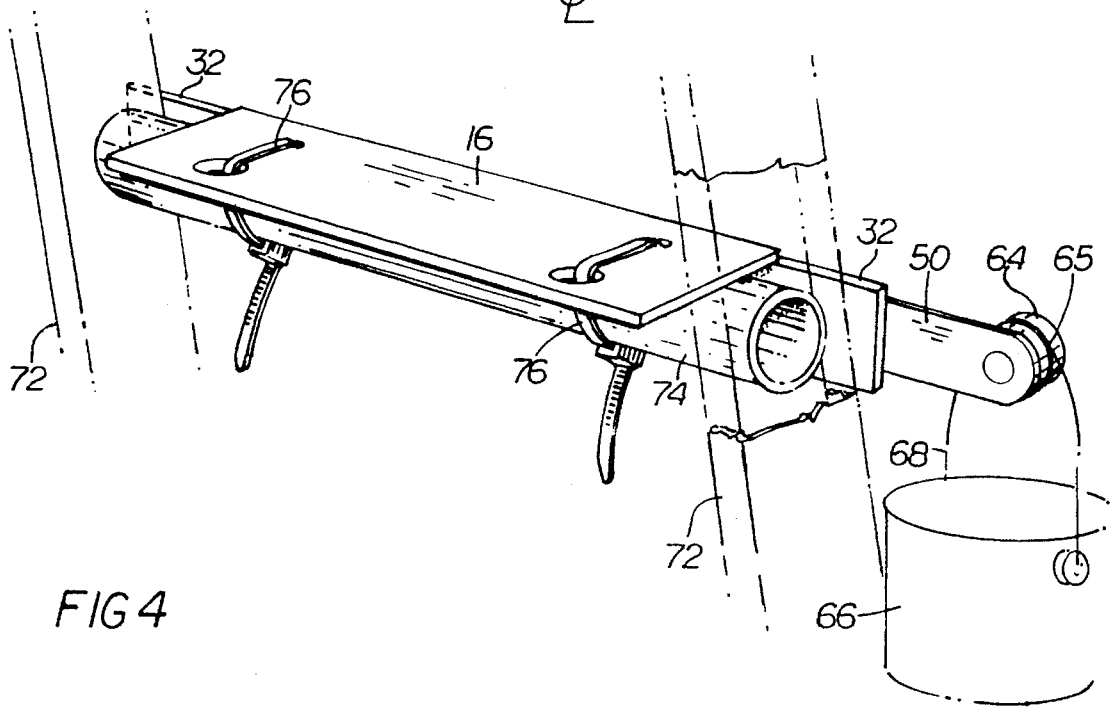
FIG 4

EXTENSIBLE SUPPORT MEANS FOR USE ON LADDER

RELATIONSHIP TO PREVIOUS INVENTION

The present invention is a Continuation-in-Part of application Ser. No. 08/306,985 filed Sep. 16, 1994, which application is being abandoned with the filing of this application.

BACKGROUND OF THE INVENTION

It has long been the practice when painting or conducting various types of repairs while standing on a ladder, to hang a container for paint or tools from the top of a step ladder, or from a selected rung of an extension ladder, thus to enable the painter or repair person to hold the ladder with both hands while changing the position of the ladder from time to time. Such an arrangement also enables a painter to be able to hold onto the ladder with one hand, with the other hand being free to dip the brush into the paint and spread the paint on the surface adjacent which the ladder resides.

The practice of suspending a paint can or tool container from a selected rung of a ladder had the obvious disadvantage that the suspended can or container was behind the ladder and thus was inconvenient for use. Various proposals have been made to support the containers in more accessible positions, and one example is the teaching of the Chovan U.S. Pat. No. 3,374,980, which issued Mar. 26, 1968 That patent, entitled "Paint Can Safety Clamp," proposed a mechanism including adjustable pan engaging clamps that is arranged to engage and lock upon the step of a ladder.

The Lunden, Jr. U.S. Pat. No. 5,293,957, entitled "Container Holding Attachment Insertable in a Tubular Ladder Rung," which issued Mar. 15, 1994, put forth the concept of providing a holder for a paint can or tool container involving a member to be inserted into the rung of a metal ladder, with the paint container supported at one side of such member.

None of these earlier arrangements has been particularly well received, with principal causes for their non-acceptance being their complexity, production costs, the inadequate support provided for paint cans and other containers, and their sheer bulk, latter fact making shipping costly and storage a problem.

It was in an effort to improve upon these prior art arrangements that the present invention was evolved.

SUMMARY OF THE INVENTION

A support device in accordance with this invention is primarily intended to be utilized on an upper portion of a ladder, such as a step ladder, or upon a selected rung of an extension ladder or the like, with our novel device comprising an elongate base member having a pair of long edges. Between these long edges, mounting means are defined, with such mounting means to be utilized for securing the base member to a selected upper part of the ladder.

An elongate receptacle extends along one of such long edges for substantially the entire length of the base member, with the ends as well as the upper portion of the elongate receptacle being open. A slidable member of elongate configuration is utilized in conjunction with the elongate receptacle, with this slidable member having a dimension such as will permit it to reside in and slidably move along the elongate receptacle. The slidable member has a first end and a second end as well as a longitudinal centerline, with a slot extending along the centerline for a substantial portion of the length of the slidable member.

This slot extends to a point relatively close to the first end of the slidable member, and the slidable member is insertable over a rigid restraint means defined in a mid portion of the receptacle, with the restraint means extending into the slot. Significantly, the slidable member is slidable in the elongate receptacle in either direction, and is able to be slid out of either end of the elongate receptacle for a limited extent. Engagement of the restraint means with the slot prevents the slidable member from coming entirely out of engagement with the elongate receptacle. Component support means of an improved type are provided adjacent the second end of the slidable member, thus enabling a component to be suspended from the second end of the slidable member when such member has been extended outwardly for a desired extent.

Because the slidable member can be slid for a desired extent out of either end of the elongate receptacle, our novel support device is readily usable by either a right handed person or a left handed person, for the slidable member can be easily oriented to either the left side or the right side of the support device.

In accordance with the preferred embodiment of our invention, the restraint means is a rigid pin or stud, and one end of the slidable member of elongate configuration is pivotally rotatable about the rigid pin. More particularly, the slidable member is easily rotatable about the rigid pin from a position in which the other end of the slidable member resides adjacent one end of the elongate receptacle, to a position in which the other end of the slidable member resides adjacent the other end of the elongate receptacle.

It is a primary object of our invention to provide a support device of inexpensive construction that can be readily installed upon any of several different types of ladders, with our device utilizing a slidable member that can be extended outwardly to a desired extent in order to form a support from which a can of paint, a container of tools, a supply of replacement bulbs, or the like can be safely suspended.

It is another object of our invention to provide a support device of simple yet highly effective construction, that can be added to an existing ladder or incorporated into the structure of a ladder being newly manufactured, with this support device utilizing a slidable member which can be extended outwardly for a desired extent from either side of the support device, thus to accommodate either a right handed or a left handed user.

It is yet another object of our invention to provide a support device comprising a base member readily secured to an upper portion of a ladder, attached to which base member is an elongate receptacle designed to slidably receive a support member readily moved from a stored position into the particular extended position that is most suitable for a person working on a ladder.

It is yet still another objective of our invention to provide a support device that is either intrinsic to a ladder or removably attached to a ladder, which support device has a member extendible from either side of the support device, with our novel support device being inexpensive to manufacture, easily packaged, and well adapted to serve as a firm support from which a paint can or other such item needed during painting or repair can be safely suspended.

It is yet still another object to provide a support device serving to orient the bail of a paint can into the most advantageous position insofar as a painter standing on a ladder being able to dip a paint brush into the can without interference from the bail.

It is still another object of this invention to provide a support device easily incorporated into the design of a ladder, or later added to an existing ladder, which support device on the one hand serves as a highly effective support for a component needed by a painter, carpenter or repairman, yet on the other hand does not interfere with the storage of the ladder when the ladder is not in use.

These and other objects, features and advantages will be made more apparent as the description proceeds.

BRIEF DESCRIPTION OF THE DRAWINGS

FIG. 1 is a perspective view of the upper portion of a conventional stepladder, affixed to the upper surface of which is a novel support device in accordance with our invention, with this figure illustrating how a slidable member forming an intrinsic part of our novel device can be extended outwardly to a desired degree, and then used to safely support a paint can, a container of tools, a supply of replacement bulbs, or the like;

FIG. 1*a* is a fragmentary view to a somewhat larger scale showing a preferred construction of the channel-like member utilized along one edge of our device for supporting the slidable member that in turn supports a paint can or the like, with this figure also revealing the positioning of the rigid pin or stud about which the slidable member is pivotally rotatable;

FIG. 3 is a perspective view showing the manner in which a user goes about installing the slidable member onto the pin or restraint means utilized in a mid portion of the channel-like member; and FIG. 4 is a perspective view showing how our novel support device can be installed upon a selected rung of an extension ladder.

DETAILED DESCRIPTION

With initial reference to FIG. 1 it will be seen that we have shown a support device 10 in accordance with this invention, which is designed for utilization on a ladder 12 or the like. In this particular instance, the ladder 12 is a step ladder, which has a top member 14.

Figure 2B:
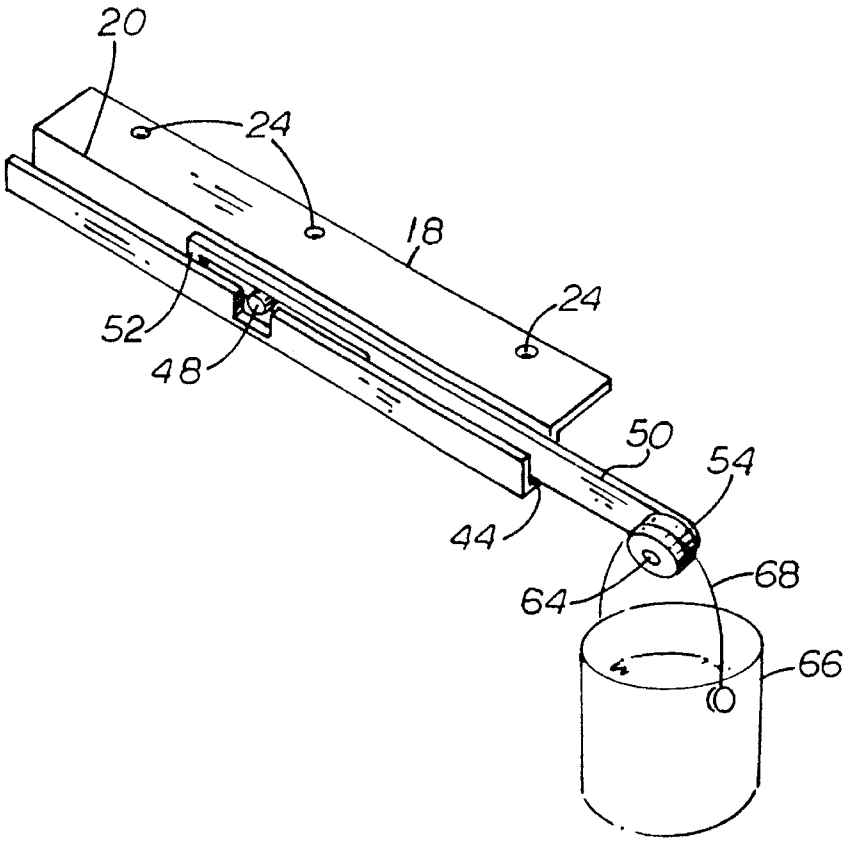
FIG. 2*b* is perspective view taken from the other end of a our novel support device, showing the slidable member in an operative, extended position, and illustrating how the component support means is configured to support the bail of a paint can or other container in a particularly advantageous orientation for the benefit of the painter or other worker.
Figure 2A:
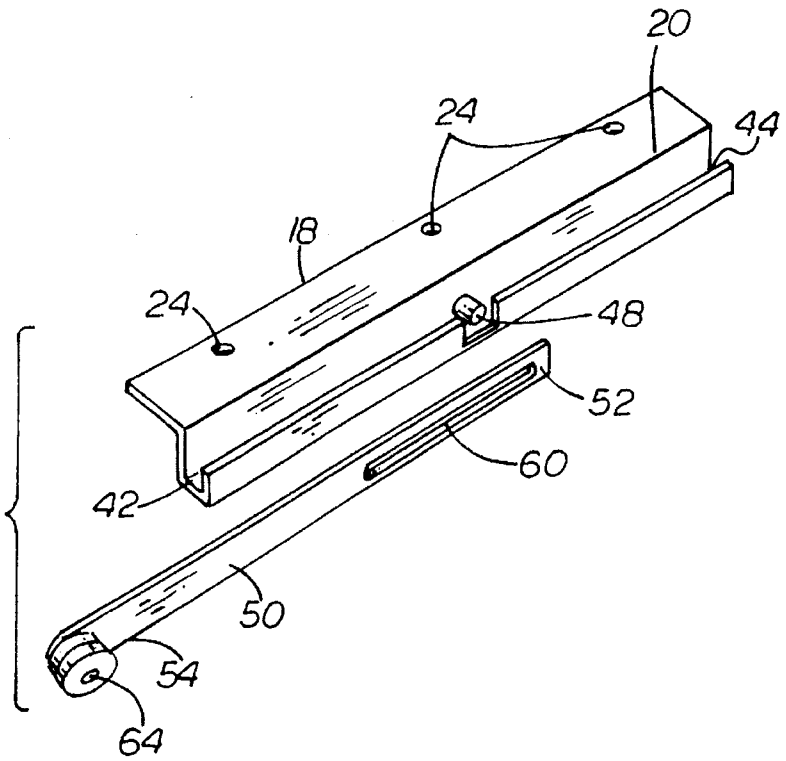
FIG. 2*a* is a perspective view taken from one end of our novel support device, from which the slidable member has been remove in the interests of illustrating internal detail.

As will be seen in FIG. 1 as well as in FIGS. 2*a* and 2*b*, our novel support device 10 comprises an elongate base member 16 having a pair of long edges 18 and 20, between which long edges, mounting means are defined. In the present instance, the ladder 12 being a step ladder, the base member 16 has a plurality of holes 24 enabling a like number of screws 26 to be utilized as the mounting means for securing the base member 16 to the top member 14 of the ladder 12. Other securing means can obviously be used, such as nut and bolt combinations. As will be seen in more detail hereinafter, when the ladder is of a different configuration, such as an extension ladder, we utilize a different type of mounting means for securing the base member 16 to a selected part or rung of the ladder.

A significant part of this invention involves the provision of an elongate receptacle 30 extending for substantially the entire length of the base member 16, being located adjacent the long edge 20. As clearly seen in FIG. 1*a*, the elongate receptacle 30 has a generally U-shaped configuration, involving an interior vertical member 32, a bottom member 34, and an outer vertical member 36, which together define a channel-like portion 40. It is to be noted from FIGS. 2*a* and 2*b* that end 42 as well as end 44 of the receptacle 30 are open, as is the uppermost portion 46 of the receptacle 30.

A pin or stud 48 is affixed at approximately a middle location in the channel-like portion 40, with the longitudinal positioning of the pin 48 being most apparent from FIGS. 2*a* and 2*b*. We also refer to the pin 48 as a restraint means, which is secured in a mid portion of the receptacle 30. The construction we utilize makes it readily possible for a slidable member 50 of elongate configuration to reside in the channel-like portion 40 of the receptacle 30. The slidable member 50 is of such a dimension such as to be able to slide easily in the elongate receptacle 30, such that it can be readily moved between active and storage positions in the channel-like portion 40.

It is to be noted that slidable member 50 has a first end 52 and a second end 54, and in addition, the member 50 has a longitudinal centerline 56, best seen in FIG. 3. A slot 60 extends along the centerline 56 for a substantial portion of the length of the slidable member 50, with the slot 60 extending to a point relatively close to the first end 52 of the slidable member 50. Typically the slot extends approximately 60% of the length of the slidable member, although we obviously are not to be limited to this percentage.

As shown in FIG. 3, the slidable member 50 is insertable over the pin or restraint means 48, with the pin extending into the slot 60. This insertion is possible because of a cutout 38 that we utilize in the outer vertical member 36.

FIG. 3 also reveals that the interior vertical member 32 is preferably slightly longer than the outer vertical member 36, and by way of example, the interior vertical member can extend outwardly on each end for approximately 1⅛ inches beyond the member 36. The purpose of this arrangement is discussed in conjunction with FIG. 4.

As a result of the advantageous construction involving the slotted member 50, the member 50 may be pivotally rotatable about the pin 48 to either the left side or the right side of the channel-like portion 40 of the receptacle 30. We may refer to this as being a "flipover" procedure, with the decision to place the slidable member 50 on the right or the left usually being made on the basis whether the painter, carpenter, installer or other worker is right handed or left handed.

From FIGS. 2*a* and 2*b* it is apparent that the slotted slidable member 50 is readily slidable in the channel-like portion 40 of the elongate receptacle 30 with respect to the base member 16, and is able to be slid for a limited extent out of either the end 42 or the end 44 of the elongate receptacle. It is to be understood that the engagement of the pin or restraint means 48 with the slot 60 of the slidable member 50 effectively prevents the member 50 from coming entirely out of the elongate receptacle 30, and it is about the pin 48 that the member pivots during the "flipover" procedure, during which the member 50 is pivotally rotated from the left end of the receptacle 30 to the right end, or vice versa. It will be obvious to those skilled in this art that the pin or restraint means 48 effectively prevents the member 50 from becoming separated from the elongate receptacle 30 when the member 50 is in an outwardly cantilevered relationship to the receptacle 30, and an item such as a paint can or a tool receptacle has been suspended from the outer end of the slotted slidable member 50. Because of the weight it must bear, it is obvious that the pin or stud 48 must be of substantial diameter, and be sturdily mounted.

It is to be noted that component support means 64 are provided adjacent the second end 54 of the slidable member 50, thus enabling a paint can 66, tool container, bulb-supporting receptacle or the like to be readily suspended from the second end 54 of the slidable member 50.

It is most important to note the advantage made possible by the utilization of the component support means 64 which, as will be apparent from FIGS. 1 and 2*b* in particular, is disposed in the plane of the slidable member 50. The support means 64 has a notch or groove 65 that extends for a substantial portion around the circumference of the member 64, thus enabling it to readily receive, in a secure manner, the bail 68 of a paint can 66 or the bail of another type of container.

The utilization of the component support means 64 in the plane of the member 50 causes the bail 68 of the can to also be disposed in the plane of the member 50, thus to be placed in a highly advantageous relationship to a person concerned with dipping a brush into the paint can.

This latter benefit is to be contrasted with the result that would be obtained if an ordinary notch were placed on one or both ends of the slidable member 50, for in such instance, the bail of a can or container placed in such a notch would be in a 90° relationship to the plane of the slidable member. This would be particularly disadvantageous to a painter standing on the ladder who is concerned with being able to readily dip a paint brush into the can.

With reference to FIG. 4 it will be seen that our novel extensible support means is manifestly not limited for use with a step ladder. In FIG. 4, we show the base member 16 secured to and resting upon a selected rung or step 74 of a ladder, which may be an extension ladder. The rung 74 is one of numerous rungs of equal length that extend between the pair of longitudinal members 72 of the ladder.

Rather than necessitating the drilling of a hole in any portion of the extension ladder, which might have a weakening effect, we prefer to utilize one or more plastic ties 76 of a well-known commercially available type for securing the base member 16 to the rung or step 74 of the ladder. As is obvious, the ends of the plastic ties are inserted through respective adjacent holes located in the base member 16, with each tie then being wrapped around the rung of the ladder. The end of each tie, after wrapping around the rung has been accomplished, is then inserted into the small aperture provided in the end of the plastic tie, with this serving to effect a locking of the tie tightly around the rung or step of the ladder. This of course brings about a very effective securing of our novel support means to the selected rung of the ladder, making it very unlikely that in any normal use, the base member 16 will become separated from the ladder.

From FIG. 4 it will be seen that the outer ends of interior member 32 extending outwardly beyond the outer ends of the outer member 36 makes it readily possible for the ends of the member 32 to engage and rest against the longitudinal members 72 of the ladder. This contact of the outer ends of the member 32 with the longitudinal members 72 of the ladder effectively prevents undesired rotation of our novel support device about the rung or step of the ladder to which the base member 16 is affixed.

Although we have shown our novel support means used only with a step ladder and a ladder in the nature of an extension ladder, it is to be understood that we are not to be limited to such utilizations, for our invention may have application in connection with other trades or businesses, rather than just being limited to use with painters or those concerned with the replacement of fluorescent tubes in the ceiling of a building or the like.

As to constructional materials, we could make the base member 16, the components defining the elongate receptacle 30, and the slidable member 50 out of lightweight metal, such as aluminum. However, we prefer to manufacture these components out of a good grade of structural plastic.

One example of a plastic material we have found suitable is A.B.S. plastic, which stands for acrylic butyrate and styrene. As an alternative, our device could be made of a combination of plastic materials with lightweight metal, such as of aluminum or the like.

Inasmuch as the base member 16 and the elongate receptacle 30 are of uniform cross-section, as made clear from FIG. 1*a*, it is obvious we can utilize an extrusion technique for manufacturing this part of our invention as a single, unitary member. In the event the slidable member is extruded, the support member 64 would be secured to the end of the slidable member, such as by an adhesive, a rivet, or by some other appropriate technique.

We are not to be limited except as required by the scope of the appended patent claims.

We claim:

1. A support device for utilization on a ladder, said device comprising an elongate base member having a pair of long edges, means defining an elongate receptacle extending along one of said long edges for substantially the entire length of said base member, said elongate receptacle having ends, with said ends being open, a slidable member of elongate configuration having a dimension to be able to reside in said elongate receptacle, said slidable member having a first end and a second end and being slidable for a limited extent out of either end of said elongate receptacle, restraint means in said elongate receptacle for preventing said slidable member from coming entirely out of either end of said elongate receptacle, and component support means adjacent one of said ends of said slidable member, thus enabling a component to be supported from said component support means of said slidable member, said slidable member having a longitudinal centerline, and a slot extending along the longitudinal centerline of said slidable member for a substantial portion of the length of said slidable member, and said restraint means involving a rigid pin disposed in a mid portion of said elongate receptacle for engaging said slot.

2. The support device for utilization on a ladder as recited in claim 1 in which said base member has a plurality of holes, enabling it to be secured to an upper portion of a step ladder, or to a selected rung of an extension ladder.

3. The support device for utilization on a ladder as recited in claim 1 in which said slidable member resides in a plane, and said component support means affixed at one end of said slidable member resides in a plane parallel to the plane of said slidable member, with the fact that said member is slidable readily enabling the component to be supported from said support means at a selected distance away from a ladder.

4. The support device for utilization on a ladder as recited in claim 1 in which said slidable member resides in a plane, and said component support means affixed at one end of said slidable member is disposed in a plane parallel to the plane of said slidable member, with said component support means being notched to enable a paint can having a bail to be supported in a parallel relationship to said slidable member, with the bail thus residing in a position in which it does not interfere with the dipping of a paint brush into the paint can supported from said support means.

5. The support device for utilization on a ladder as recited in claim 1 in which said elongate receptacle has an upper portion, and said upper portion of said elongate receptacle is open and one end of said slidable member of elongate configuration is pivotally rotatable about said rigid pin, with said slidable member being rotatable about said pin from a position in which the other end of said slidable member resides adjacent one end of said elongate receptacle, to a position in which the other end of said slidable member resides adjacent the other end of said elongate receptacle.

6. A support device for utilization on a ladder, said device comprising an elongate base member having a pair of long edges, between which long edges mounting means are defined, said mounting means to be utilized for securing said base member to an upper part of a ladder, means defining an elongate receptacle having ends and an upper portion, said elongate receptacle extending along one of said long edges for substantially the entire length of said base member, with the ends as well as the upper portion of said elongate receptacle being open, a slidable member of elongate configuration having a dimension such as to be able to reside in said elongate receptacle, said slidable member having a first end and a second end and being slidable for a limited extent out of either end of said elongate receptacle, restraint means in said elongate receptacle for preventing said slidable member from coming entirely out of either end of said elongate receptacle, and component support means adjacent one of said ends of said slidable member, thus enabling a component to be supported from said component support means of said slidable member, said slidable member having a longitudinal centerline, and a slot extending along the longitudinal centerline of said slidable member for a substantial portion of the length of said slidable member, and said restraint means involving a rigid pin disposed in a mid portion of said elongate receptacle for engaging said slot.

7. The support device for utilization on a ladder as recited in claim 6 in which said base member has a plurality of holes, enabling it to be secured to an upper portion a step ladder, or to a selected rung of an extension ladder.

8. The support device for utilization on a ladder as recited in claim 6 in which said slidable member resides in a plane, and said component support means affixed at one end of said slidable member resides in a plane parallel to the plane of said slidable member, with the fact that said slidable member is slidable readily enabling a component to be supported from said support means at a selected distance away from a ladder.

9. The support device for utilization on a ladder as recited in claim 6 in which said slidable member resides in a plane, and said component support means affixed at one end of said slidable member is disposed in a plane parallel to the plane of said slidable member, with said component support means being notched to enable a paint can having a bail to be supported in a parallel relationship to said slidable member, with the bail thus residing in a position in which it does not interfere with the dipping of a paint brush into the paint can supported from said support means.

10. The support device for utilization on a ladder as recited in claim 6 in which said slidable member of elongate configuration is pivotally rotatable about said rigid pin, with one end of said slidable member being rotatable about said pin from a position in which the other end of said slidable member resides adjacent one end of said elongate receptacle, to a position in which the other end of said slidable member resides adjacent the other end of said elongate receptacle.

11. A support device for utilization on a ladder, said device comprising an elongate base member having a pair of long edges, between which long edges mounting means are defined, such mounting means to be utilized for securing said base member to an upper part of a ladder, means defining an elongate receptacle having ends and an upper portion, said elongate receptacle extending along one of said long edges for substantially the entire length of said base member, with the ends as well as the upper portion of said receptacle being open, restraint means defined in a mid portion of said receptacle, a slidable member of elongate configuration having a dimension to be able to reside in said elongate receptacle, said slidable member having a first end and a second end as well as a longitudinal centerline, with a slot extending along said centerline for a substantial portion of the length of said slidable member, with said slot extending to a point relatively close to said first end of said slidable member, said slidable member being insertable over said restraint means, with said restraint means extending into said slot, said slidable member being slidable in said elongate receptacle and able to be slid out of either end of said elongate receptacle for a limited extent, with the engagement of said restraint means with said slot preventing said slidable member from coming entirely out of said elongate receptacle, and component support means mounted adjacent said second end of said slidable member.

12. The support device for utilization on a ladder as recited in claim 11 in which said base member has a plurality of holes, enabling it to the secured to the top of a step ladder, or to a selected rung of an extension ladder.

13. The support device for utilization on a ladder as recited in claim 11 in which said restraint means is a rigid pin, one end of said slidable member of elongate configuration being pivotally rotatable about said rigid pin, with said slidable member being rotatable about said pin from a position in which the other end of said slidable member resides adjacent one end of said elongate receptacle, to a position in which the other end of said slidable member resides adjacent the other end of said elongate receptacle.

14. The support device for utilization on a ladder as recited in claim 11 in which said slidable member has a plane, and said component support means affixed at one end of said slidable member resides in a plane parallel to the plane of said slidable member, with the fact that said member is slidable readily enabling a component to be supported from said support means at a selected distance away from a ladder.

15. The support device for utilization on a ladder as recited in claim 11 in which said component support means affixed at one end of said slidable member is disposed in a plane parallel to the plane of said slidable member, with said component support means being notched to enable a paint can equipped with a bail to be supported in a parallel relationship to said slidable member, with the bail thus residing in a position in which it does not interfere with the dipping of a paint brush into a paint can supported from said support means.

* * * * *